United States Patent [19]

Yamanaka et al.

[11] 4,167,659

[45] Sep. 11, 1979

[54] OPERATION MECHANISM OF SWITCH

[75] Inventors: Takashi Yamanaka, Amagasaki; Keikichi Kondo, Takarazuka, both of Japan

[73] Assignee: Mitsubishi Denki Kabushiki Kaisha, Tokyo, Japan

[21] Appl. No.: 755,942

[22] Filed: Dec. 30, 1976

[30] Foreign Application Priority Data

Jan. 6, 1976 [JP] Japan ..... 51/1026

[51] Int. Cl.[2] ..... H01H 3/00

[52] U.S. Cl. ..... 200/153 E; 200/153 L; 200/153 LA; 200/153 R; 200/329

[58] Field of Search ..... 200/153 E, 153 LA, 153 L, 200/153 T, 153 R, 329; 335/174, 175, 165, 166

[56] References Cited

U.S. PATENT DOCUMENTS

| | | | |
|---|---|---|---|
| 1,531,606 | 3/1925 | Grebe | 200/153 LA |
| 1,947,275 | 2/1934 | Sachs | 200/153 E |
| 3,249,725 | 5/1966 | Hutt | 200/153 LA |
| 3,835,275 | 9/1974 | Preuss | 200/153 L |
| 3,906,178 | 9/1975 | Fiddler | 200/153 LA |
| 4,110,581 | 8/1978 | Meunier | 200/153 LA |

*Primary Examiner*—Ro E. Hart

*Attorney, Agent, or Firm*—Oblon, Fisher, Spivak, McClelland & Maier

[57] ABSTRACT

An operation mechanism of a switch comprises a first slidable device connected to a moving electrode of the switch; a second slidable device faced to the first slidable device with a gap; and a wedge type element which is inserted between both slidable devices to move the first slidable device depending upon the movement by a driving means and to move the moving electrode, whereby the electrode of switch is turned on and off depending upon the movement of the wedge type element inserted between both of the slidable devices.

6 Claims, 4 Drawing Figures

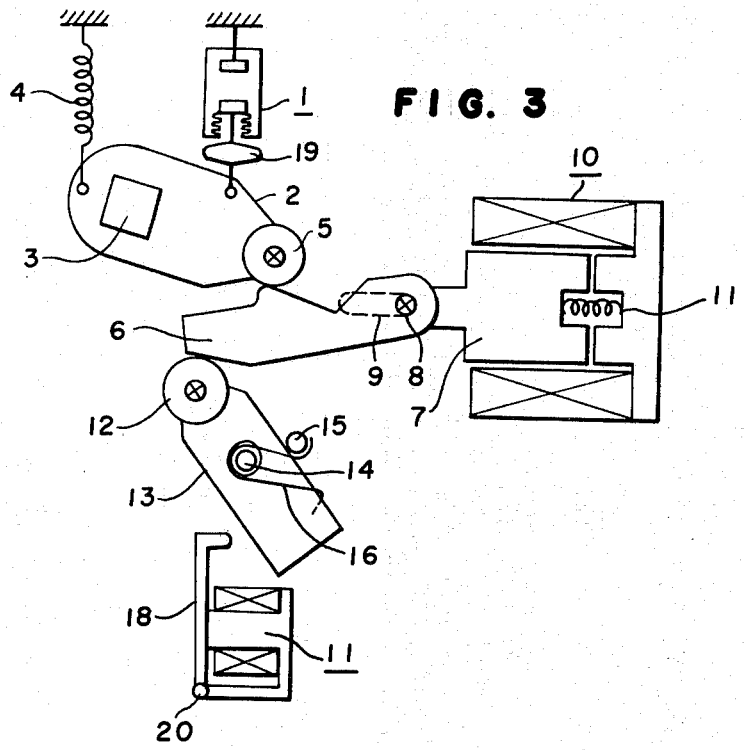
FIG. 3
FIG. 4
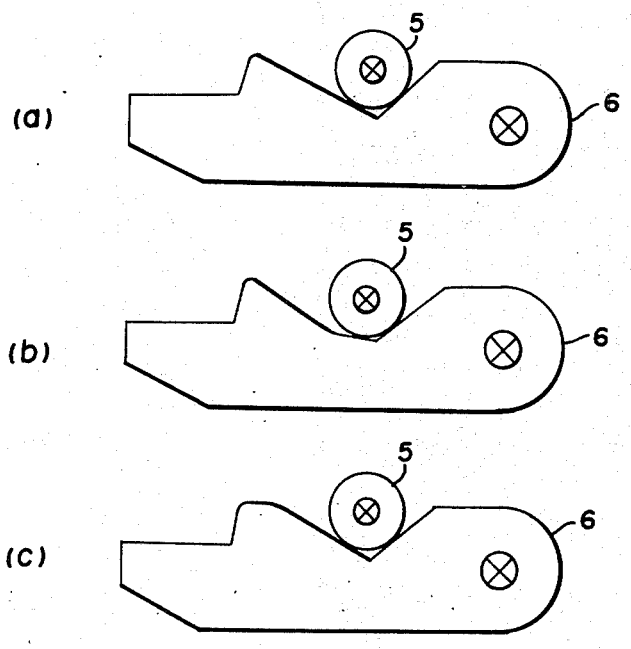

OPERATION MECHANISM OF SWITCH

BACKGROUND OF THE INVENTION

1. Field of the Invention

The present invention relates to an improvement of the operation mechanism of switch.

2. Description of Prior Art

In the conventional operation mechanism of switch, the driving force of an electromagnetic force of an electromagnet and a cylinder output has been transmitted through a lever or a toggle to a moving electrode of a switch so as to close the switch. (a closing of a switch means a making of a switch). The closing latch has been interlocked to maintain the close-circuit state so as to prevent the tripple even though the driving force to the lever and the toggle is zero at the position completing the close-circuit. The switch has a trip free mechanism wherein the trip can be attained regardless the driving force by disconnecting a hook which is formed at a part of a connecting part of the lever or the toggle.

Accordingly, the closing latch and the hook have been needed and the interlocking part for interlocking the hook or the closing latch to the lever or the toggle in accurate size, has been also needed. Accordingly, the large number of parts have been needed and the mechanism has been complicated and a large trouble for preparing a compact and light one has been found.

The closing characteristic of a switch is dependent upon mutual effects of a lever, a toggle and a driving force etc. In order to obtain a desired characteristic, it has been required to rearrange the mechanism to cause a structure in low degree of freedom.

A cost of an operation mechanism is usually in high ratio for a cost of a switch and accordingly the cost of the conventional switch has been expensive.

The present invention is to overcome these disadvantages.

SUMMARY OF THE INVENTION

It is an object of the present invention to provide an operation mechanism of a switch which has a simple structure and can be miniaturized.

Another object of the invention is to provide an operation mechanism of a switch which can impart a desired closing characteristic by changing a shape of one part.

These objects of the invention can be attained by providing an operation mechanism of a switch which comprises a first slidable device connected to a moving electrode of the switch; a second slidable device faced to the first slidable device with a gap; and a wedge type element which is inserted between both slidable devices to move the first slidable device depending upon the movement by a driving means and to move the moving electrode whereby the electrode of the switch is turned on and off depending upon the movement of the wedge type element inserted between both of the slidable devices.

BRIEF DESCRIPTION OF THE DRAWINGS

FIGS. 1 to 3 are respectively schematic views for illustrating the operation of one embodiment of the present invention;

FIG. 1 shows the open-circuit state of the electrode;

FIG. 2 shows the close-circuit state of the electrode and

FIG. 3 shows the state at the time opening the electrode; and

FIG. 4(*a*), (*b*) and (*c*) show views of the important parts in the other embodiment of the invention.

DESCRIPTION OF THE PREFERRED EMBODIMENTS

Figure 1:
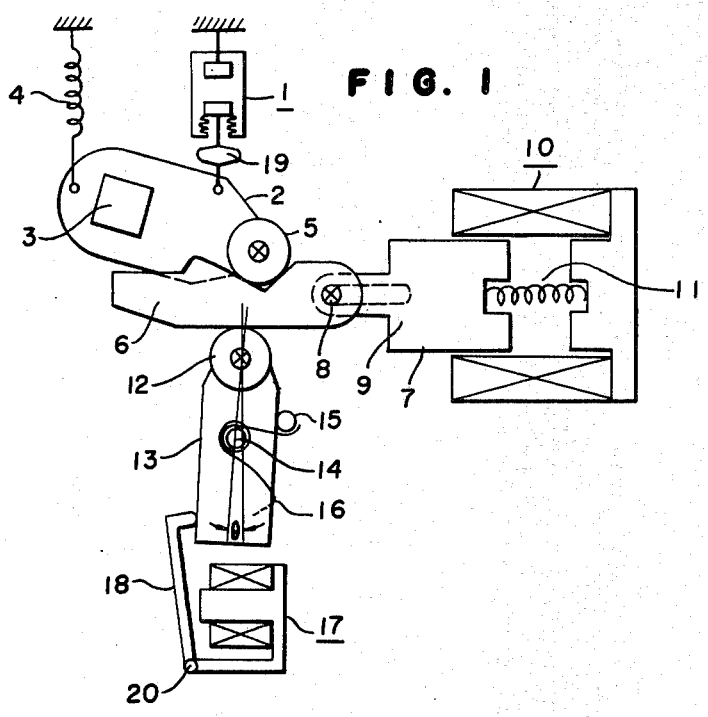
Figure 2:
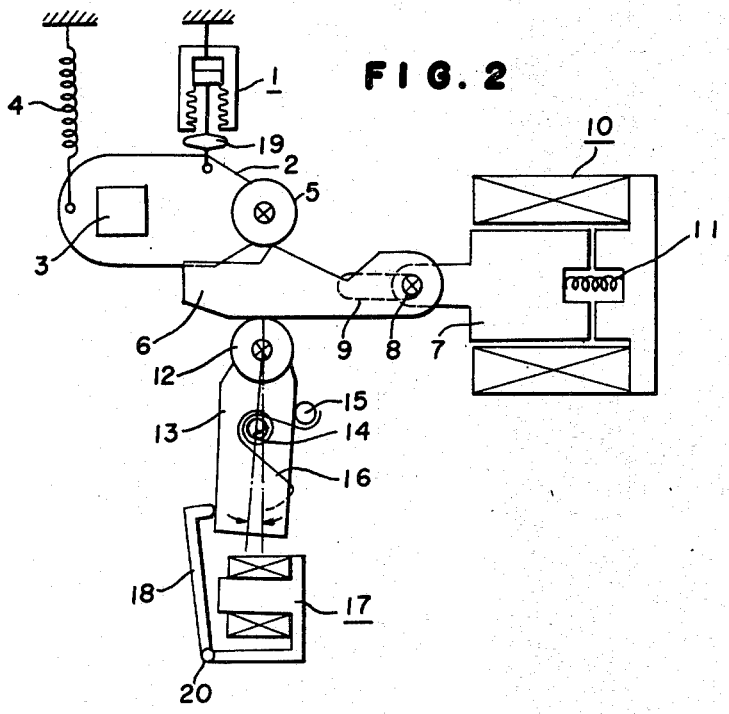

Referring to FIGS. 1 to 3, one embodiment of the present invention will be illustrated in detail.

In FIG. 1, the open-circuit state of the vacuum switch is shown. A vacuum valve (1) is connected through a suitable insulating means and a flange having a compression spring (19) to an arm (2) having a moving roller (5) at the end thereof. (the first slidable device). The moving roller is fitted so as to be turned around a shaft (3).

An open-circuit spring (4) is disposed so as to form the open-circuit in the normal state by actuating the spring through the arm (2) to the vacuum valve (1). The moving roller (5) is contacted with the bottom of the V shape of a wedge type metal element (6) (wedge element) which is rotatably connected through a pin (8) to a moving-core (7) of a magnet (10). The pin (8) can be slidable to the right and left direction in a groove (9) formed on a side plate (not shown). A suitable releasing spring (11) is disposed between the moving-core (7) and the magnet (10). The pin (8) is pushed to the left end of the groove (9) by the spring force. The bottom of the wedge type metal element (6) is held by a guide roller (12). The guide roller (12) is rotatably pivoted on a rotary supporter (13) around a shaft (14). The supporter (13) has a stopper (15) so as to incline it to the right direction with fine angle $\theta$ to the line connecting the bottom of the wedge type metal element (6), the contact of the roller (12) and the center of the roller (12). The supporter (13) is inclined to the right direction in the normal state by a twisting coil spring (16). A trip lever (18) is contacted with the lower end of the supporter (13) so as to clockwise turn it around a shaft (20) under forming the magnetic circuit of the trip magnet (17).

When the magnet (10) is excited, the moving core (7) is attracted, and the wedge type metal element (6) is moved to the right direction under guiding with the guide roller (12) and the groove (9), whereby the moving roller (5) is lifted up depending upon the slant of the wedge type metal element (6), and the arm (2) is counter-clockwise turned around the shaft (3) to close the electrode of the vacuum valve (1).

In FIG. 2, the final state of the vacuum switch is shown. When the moving roller (5) is disposed to slightly over-run the top of the wedge type metal element (6) at the time contacting the pin (8) to the right end of the groove (9), the wedge type metal element (6) is pushed to the right direction by the force of the open-circuit spring (4). Even though the excitation of the magnet (10) is released, the state is maintained. As the result, the condition of interlocking the closing latch is provided. FIG. 2 shows the complete close-circuit state.

When the trip magnet (17) is excited in the state of FIG. 2, the trip lever (18) is attracted to counter-clockwise turn the supporter (13). When the rotary angle is over the angle $\theta$, the supporter (13) can not maintain the wedge type metal element (6) in the horizontal direction. The arm (2) is clockwise turned by the open-circuit spring (4) and the wedge type metal element (6) is counter-clockwise turned around the pin (8) and the supporter (3) is clockwise turned whereby the vacuum valve (1) is tripped.

FIG. 3 shows the trip state of the vacuum switch. Then, the wedge type metal element (6) is moved to the left direction by the force of the releasing spring (11). Depending upon moving the moving roller (5) to the bottom of the V shape part, the supporter (13) is clockwise turned by the twist coil spring (16) to the state of FIG. 1. The trip is completed and the open-circuit state is maintained.

When the trip magnet (17) is excited in the state of FIG. 1, The supporter (13) is counter-clockwise turned. Even though the magnet (10) is excited at the time, the wedge type metal element (6) is not horizontally moved but is moved under slant to the left direction. Accordingly, the vacuum valve is not closed to be the trip free mechanism.

When the moving roller (5) is directly pivoted at the lower part of the flange (19) and the normal open-circuit is provided by the other manner in the embodiment, the arm (2) and the shaft (3) are not needed.

As stated above, the closing latch trip free mechanism can be formed by the function of the wedge type metal element (6) and the supporter (3). Accordingly, it is possible to provide a vacuum switch which has a simple and miniaturized structure and high durability and is economical.

When the slant shape of the wedge type metal element (6) is a desired one as shown in FIG. 4, the movement of the moving roller (5) can be selected as desired. FIG. 4(*a*) is for moving in lenear; FIG. 4(*b*) is for gradually increasing the velocity and FIG. 4(*c*) is for gradually decreasing the velocity. It is possible to select the ideal shape under the consideration of the characteristics of the attractive force of the maggent (10) and the characteristics of the open-circuit spring and the compressing spring of the vacuum valve.

Of course, the mutual stroke of the electrodes can be varied by selecting the difference of the heights of the wedge type metal element, and the magnet stroke can be selectively decided by varying the average slant.

The case using an electromagnet as the driving power has been illustrated. Thus, the invention is not limited to the structure and an air cylinder, a hydraulic cylinder or a manual operation can be used as the driving power.

The vacuum switch of the invention has been illustrated. Thus, the invention can be applied for most of switches such as an oil switch, a small oil switch, an air break switch, a $SF_6$ gas switch, etc.

As stated above, in accordance with the invention, the operation mechanism can be formed with small number of parts to provide a small, light and economical switch. A desired closing characteristic can be advantageously selected by chaning a shape of one part.

What is claimed is:

1. An operation mechanism of a switch which comprises a first slidable device connected to a moving electrode of the switch; a second slidable device faced to the first slidable device with a gap; and a wedge type element which is inserted between both slidable devices to move the first slidable device depending upon the movement by a driving means and to move the moving electrode, whereby the electrode of the switch is turned on and off depending upon the movement of the wedge type element inserted between both of the slidable devices.

2. An operation mechanism of a switch according to claim 1, wherein a concave is formed on the sliding surface of the wedge type element to the first slidable device and a stopping part for the first slidable device is formed at the end thereof whereby the first slidable device is stopped at the stopping part to prevent the return operation of the wedge type element when the driving force of the wedge type element is released after closing the switch by driving the wedge type element.

3. An operation mechanism of a switch which comprises a first slidable device connected to a moving electrode of the switch; a second slidable device faced to the first slidable device with a gap; and a wedge type element which is inserted between both slidable devices to move the first slidable device depending upon the movement by a driving means and to move the moving electrode whereby the electrode of the switch is turned on and off depending upon the movement of the wedge type element inserted between both of the slidable devices and the second slidable device is held to be turned to the direction driving the wedge type element.

4. An operation mechanism of a switch according to claim 3, wherein the second slidable device is inclined to the direction perpendicular to the wedge type element at a constant angle and the slant angle is resiliently held.

5. An operation mechanism of a switch according to claim 3, wherein the open-circuit operation of the electrode of the switch by moving the first slidable device is prevented even though the wedge type element is drived in the state inclining the second slidable device to the reverse direction to the slant direction thereof.

6. An operation mechanism of a switch according to claim 3, wherein when the first slidable device is moved to open the electrode of the switch by driving the wedge type element to turn the second slidable device of the reverse direction to the slant direction thereof at a constant angle so as to open the electrode and then the driving force of the wedge type element is released, the wedge type element is returned by the stability thereof and the first slidable device is moved to the position at the concave of the wedge type element and the second slidable device is turned to stop at a constant angle to the wedge type element by the stability thereof.

* * * * *